United States Patent [19]

Fritzinger

[11] Patent Number: 4,590,455

[45] Date of Patent: May 20, 1986

[54] TRAFFIC CONTROL SYSTEM USING TIMED BLINK SIGNAL AND ROAD MARKER

[76] Inventor: George H. Fritzinger, 15 Standish Ave., West Orange, N.J. 07052

[21] Appl. No.: 165,746

[22] Filed: Jul. 3, 1980

Related U.S. Application Data

[63] Continuation-in-part of Ser. No. 87,583, Oct. 22, 1979, Pat. No. 4,371,863, which is a continuation-in-part of Ser. No. 905,350, May 12, 1978, Pat. No. 4,200,860, which is a continuation-in-part of Ser. No. 681,539, Apr. 29, 1976, abandoned.

[51] Int. Cl.[4] ..... G08G 1/096; G08G 1/095

[52] U.S. Cl. ..... 340/907; 116/63 R; 340/916

[58] Field of Search ..... 340/43, 41 R, 42, 44, 340/37; 116/63 R

[56] References Cited

U.S. PATENT DOCUMENTS 2,007,801 7/1935 Halvorson ..... 340/43
2,016,220 10/1935 Anderson ..... 340/41 R
2,057,186 10/1936 Freeberg ..... 340/41 R
2,407,432 9/1946 Manewich ..... 340/43
2,683,868 7/1954 McKnight ..... 340/43

*Primary Examiner*—James J. Groody

[57] ABSTRACT

A traffic control system is provided wherein the green and/or red signal lights are blinked momentarily at a predetermined interval before the direction of traffic is changed, and wherein a marker is placed along the roadway at a normal distance of travel within the timing of the blink signal to enable motorists to gauge their driving to save gasoline and achieve greater safety solely by noting their location relative to the marker when the blink signal occurs. Further, the invention relates to the use of this traffic signalling system in connection with a semi-actuated controller having a synchrolizer providing a background cycle, wherein the timing of the blink signal and the yellow caution signal is obtained from the synchrolizer. A specific feature resides in a novel means to prevent the synchrolizer from triggering a change in direction of traffic without a prior actuation of the blink signal.

7 Claims, 5 Drawing Figures

FIG. 1
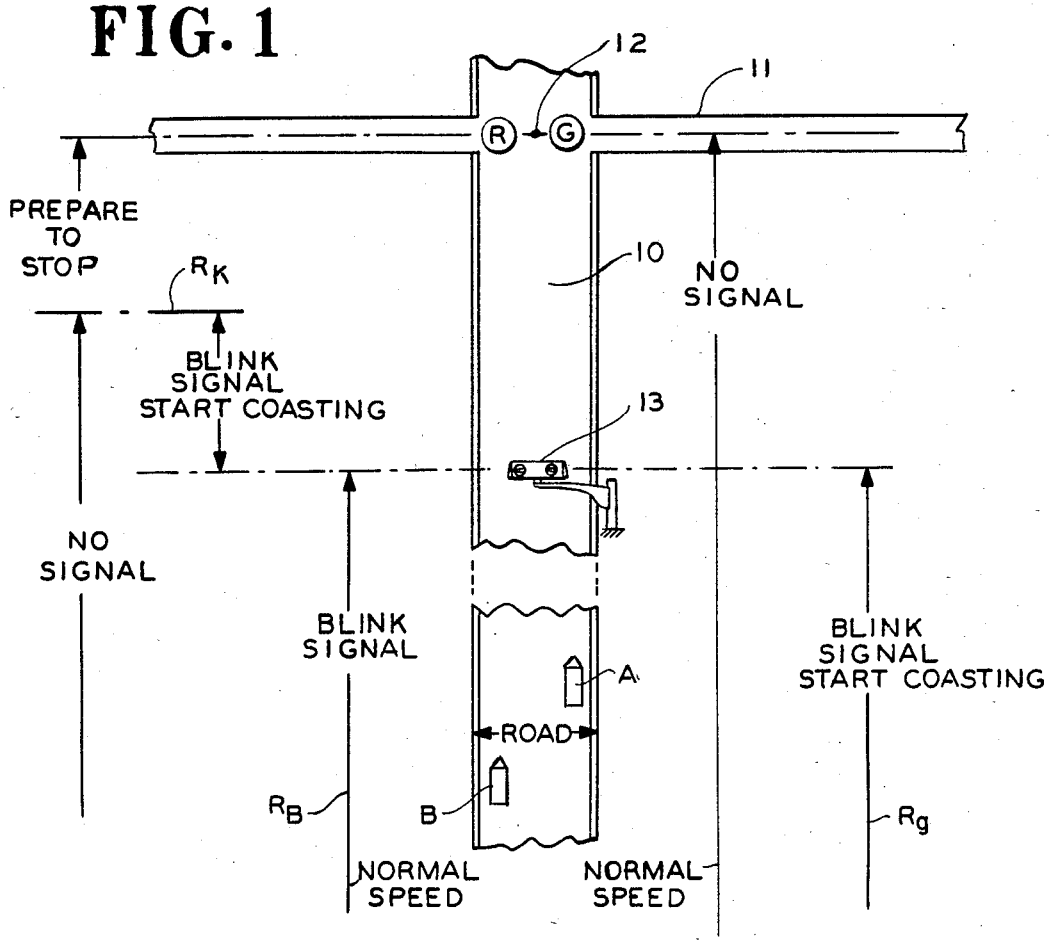
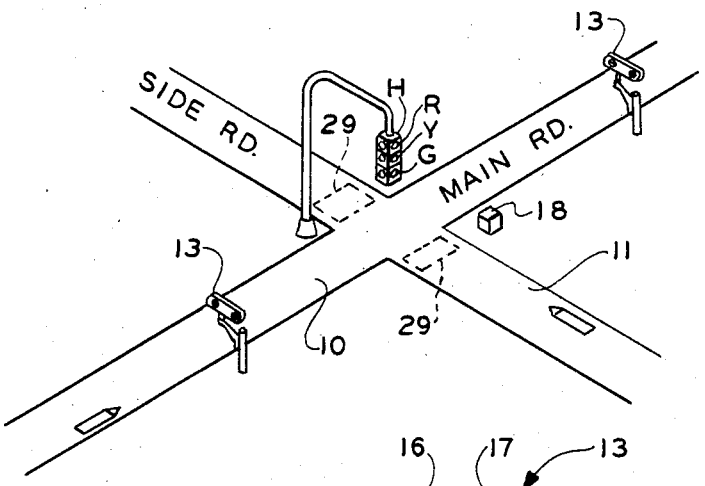
FIG. 2
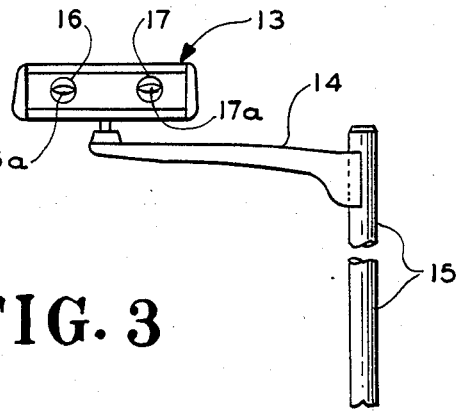
FIG. 3

FIG. 4
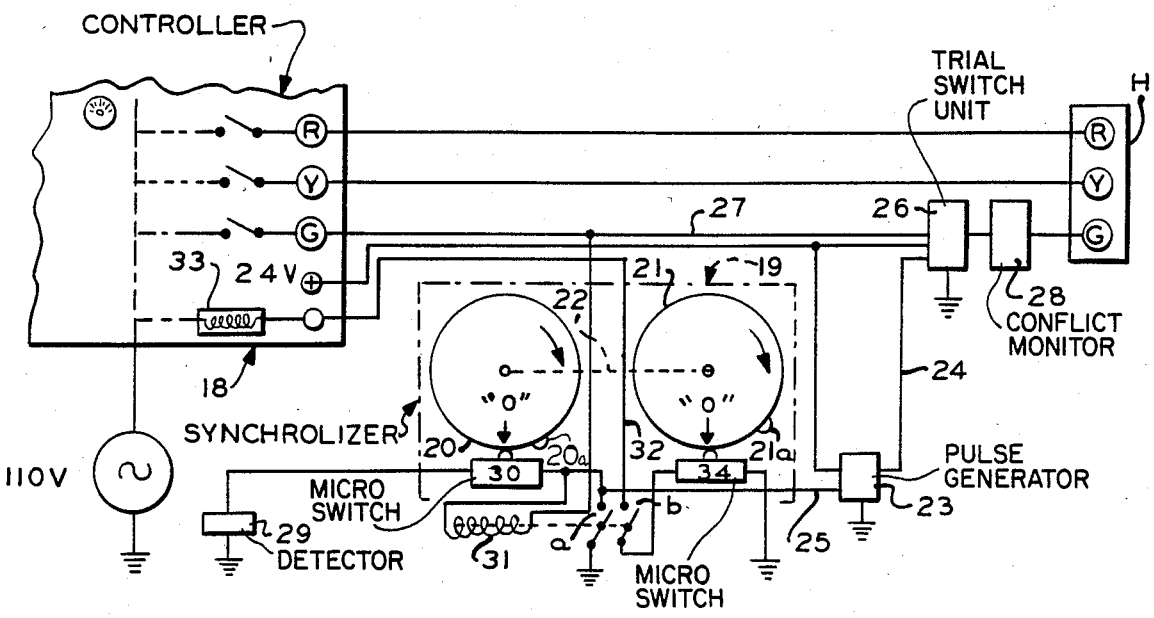
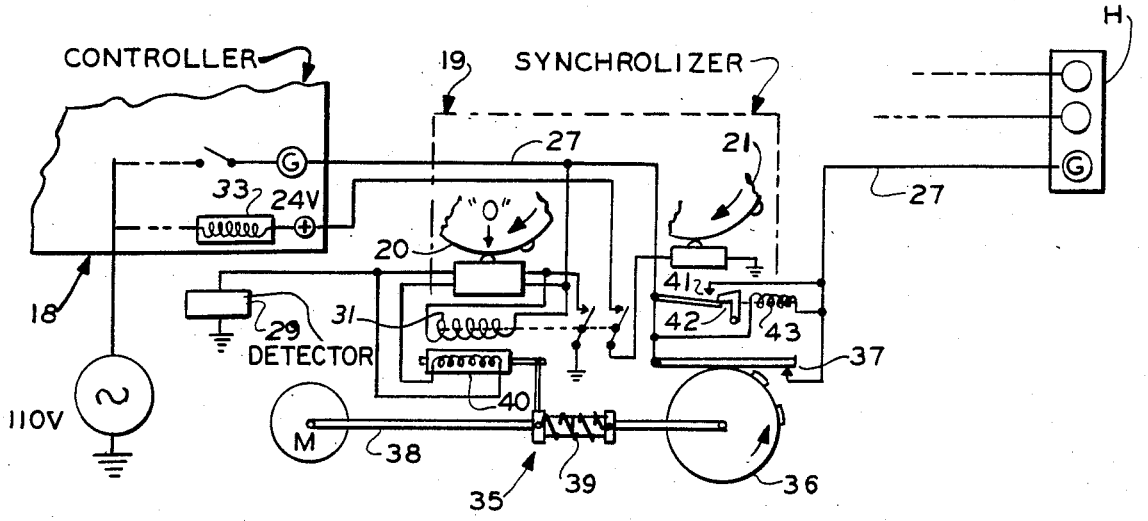
FIG. 5

TRAFFIC CONTROL SYSTEM USING TIMED BLINK SIGNAL AND ROAD MARKER

CROSS REFERENCE TO RELATED APPLICATIONS

This application is a continuation-in-part of application Ser. No. 087,583 filed Oct. 22, 1979, now U.S. Pat. No. 4,371,863 which in turn is a continuation-in-part of application Ser. No. 905,350 filed May 12, 1978, now U.S. Pat. No. 4,200,860 issued Apr. 29, 1980, which in turn was a continuation-in-part of my application Ser. No. 681,539 filed Apr. 29, 1976 and abandoned on the filing of application Ser. No. 905,350.

It is an object of my invention to provide a signal in connection with a marker to enable motorist to gauge their driving to save gasoline and at the same time achieve a greater measure of safety than has been heretofore possible.

Another object is to provide a blink signal in connection with a marker whereby the motorist can interpret the signal by the single concept of noting his location relative to the marker when the signal occurs.

Another object is to provide a marker in connection with a blink signal to eliminate the need for a motorist to count-down the timing of the signal and/or to make any estimate of distance in interpreting the signal.

Another object is to provide such blink signal timed to occur at a predetermined interval before the direction of traffic is changed, wherein the blink signal is used in connection with a marker to render it unnecessary that the motorist be aware of the timing of the signal.

Another object is to provide a simple traffic control system using a blink signal in connection with a semi-actuated controller having a synchrolizer providing a back-ground cycle, wherein the synchrolizer provides the timing for the blink signal and is conditioned by the actuation of the blink signal to trigger the controller to change the direction of traffic.

In the description of my invention, reference is made to the accompanying drawings, of which FIG. 1 is a diagram with legends indicating the interpretations to be given to the blink of the green and/or red lights relative to the location of the motorist to the marker when the blink signal occurs;

FIG. 2 is a perspective view of a traffic intersection illustrating the simplest form of application of the blink signal with a marker, wherein only the green signal on the main road is blinked and the controller is of the semi-actuated type having a synchrolizer providing a background cycle;

FIG. 3 is a front view of a preferred marker mounted over the roadway by a cantilever arm from a post at the side of the road;

FIG. 4 is a circuit diagram illustrating the incorporation of a blink signalling in a semi-actuated controller of the solid-state type wherein the controller has a synchrolizer providing a background cycle; and FIG. 5 is a fractional circuit diagram as in FIG. 4 but wherein the controller is of the mechanical type.

With reference to the diagram of FIG. 1, the two heavy lines represent a main road 10 and the two light lines a side road 11 defining an intersection 12. At the intersection is a signal head H having the usual red, yellow and green lights R, Y and G. (See FIG. 2.) On the main road are overhead markers 13 at a distance from the intersection depending on the timing of the blink signal and the normal speed or speed limit on the main road. For example, if the timing of the blink signal is 6 seconds and the speed limit is 40 mph, this distance is approximately 350′. Since this is the distance a car will travel in the timing of the blink signal at the speed limit on the roadway, it is apparent that when a motorist in car A sees a blink of the green signal light in Area Rg before he has reached the marker, he will not reach the intersection before the green light turns to red, with the result that he will have to stop and wait through the red interval at an expense of a great waste of gasoline. Thus, the interpretation of a blink of the green signal light before reaching the marker is to Start Coasting. Assuming the red interval is 30 seconds, a driver at the speed limit of 40 mph would travel 1750′ (5×350) during the red interval and an additional 350′, i.e., 2100′, from the time he sees the blink signal until the green light turns to red and back to green. Thus, if a blink of the green light occurs when a driver is at any distance as far as 1750′ from the marker, he should start slowing down by coasting. The important thing is that he can respond to save gasoline by the single concept of noting his location relative to the marker when the blink signal occurs. He need not know the timing of the signal; rather, to be unaware of the timing may be advantageous in that a knowledge of the timing might obscure his interpretation and response solely as to his location.

On seeing a blink of the green light when in the area past the marker, the driver can maintain his speed or even speed up if conditions permit and get through the intersection with a greater margin. Since there is no problem in this area, it is advocated that no instruction be given to the public as to drivers passing the marker before the blink signal occurs. Further, drivers who come into view of the green light during the first half portion of the green interval have no problem because by normal driving they will get through the intersection before the blink signal occurs.

As to the motorist in car B who sees a blink of the red light when in Area Rb before reaching the marker, no instruction is needed because in normal driving the red light will have turned to green before he reaches the intersection. As to the motorist who sees the blink of the red light when he is at or just past the marker, say to a halfway distance Rk between the marker and the intersection, the message is immediately to Start Coasting. As to the motorist who has passed this halfway point without seeing any blink signal, the strong message is immediately To Prepare to Stop. The safety advantage of a use of the blink signal in these instances is that he can gauge his driving before he reaches the stop line—i.e., up to a time of 6 seconds and a distance of 350′ from the intersection—to slow down sufficiently oftentimes to get through the intersection without coming to a stop, or if he has to stop, to do so gradually. Thus, he can save gasoline and at the same time achieve a greater safety.

The preferred marker 13 illustrated in FIG. 3 comprises a rectangular sign head frame mounted over the right lane of the roadway by a cantilever arm 14 from a post 15 at the side of the roadway. The frame carries a panel 15 having a reflective sheeting on its front side facing the traffic approaching the intersection. This reflective side is imprinted by silk screening with two circular symbols 16 and 17 of which the symbol 16 at the left is with a solid red color and the symbol 17 at the right with a solid green color having respective openings 16*a* and 17*a* at the center defined by two arcs to give the marker a distinctiveness indicating two blinks. The use of red and green symbols is to indicate that the marker is applicable to both a blinking of the red and green signal lights.

In FIGS. 2 and 4, there is illustrated the use of the blink signal with a marker in connection with a semi-actuated controller 18 of the solid state form having a synchrolizer 19 providing a background cycle. This form of controller is used commonly on the highways having the heavy truck traffic. In this operation, the green light is retained continuously on the main road until a car is first detected on the side road and the synchrolizer is moved through "0" position—which can be any time up to the timing of the synchrolizer, typically 60 seconds. The use of a blink signal with a marker on these highways, wherein only the green light on the main road is blinked, is the simplest and most effective application of this signalling because (1) the synchrolizer provides the timing for the blink signal, and (2) the blink of the green light on these highways encompasses the heavy trucks which get only 3 to 4 miles per gallon of fuel, to key the cars and trucks into coasting for long distances from the intersection at a tremendous saving of gasoline.

The synchrolizer 19 of the above semi-actuated controller is provided with two cams 20 and 21 driven in unison by an interconnecting shaft 22 at a uniform speed of one revolution per minute. The blink signal is developed by a dual-pulse generator 23 of a digital type using standard gates. The generator is operated from the 24-volt source of the controller to feed two pulses out on its output line 24 when a voltage or ground is connected to its input line 25. The output voltage is fed into a solid-state switch 26 also powered from the 24-volt source. The switch has a photo-isolated coupling as is required in the traffic control field. The switch is connected in the power line 27 running from the controller to the signal lamp G of the signal head H. As is required in connection with solid-state controllers, a conflict monitor 28 is also connected in the power line 27. In response to the two pulses from the generator, the switch 26—which stands normally closed—is opened twice in succession by the respective pulses. As before described, the preferred double blink is one comprised of two ⅛th second open intervals separated by a ⅛th second closed interval.

Detectors 29 are mounted underground in the areas of the side road 11 leading to the intersection. The effect of a car passing over one of the detectors is to close the circuitry thereof to ground. Thus, when a car is detected, a subsequent closure of a microswitch 30 by a button 20*a* on the first cam 20 of the synchrolizer moving through "0" is to complete a ground connection to the input line 25 of the generator 23 to trigger the generator and at the same time to complete a ground connection for a relay 31 from the power line 27 for the green signal light. The operation of the relay closes a hold circuit therefor at its "a" contacts and ables a circuit for the standard ratchet solenoid of the controller at its "b" contacts. At a preset interval of several seconds determined by the relative setting of the cams of the synchrolizer, a microswitch 34 is closed by a button 21*a* on the cam 21 to cause the ratchet solenoid 33 to be operated to shift the controller from the green to yellow phases. As the power is cut off for the green signal, the relay 31 is dropped out to return the control circuitry for the blink signal to its original condition. At a predetermined interval thereafter determined by the setting of the yellow knob K of the controller, the yellow phase is ended and the red light comes on. The function of the relay 31 is to prevent the synchrolizer from triggering the controller to switch from the green to yellow phase unless the system is first actuated responsive to detection of a car to provide the blink signal.

In a mechanical controller there is no 24-volt source for operating a generator of solid state form as above described, making it desirable as shown in FIG. 5 to use a one-revolution drive 35 for a two lobe cam 36 to operate a mechanical interrupter switch 37 in place of the generator 23 and switch 26 of FIG. 4. The relay 31 is used again for the same purposes as before described. The one-revolution drive comprises a small synchronous motor M having a drive shaft 38 geared down to 60 rpm and coupled through a standard one-revolution clutch 39 to the cam 36 for operating the interrupter switch 37 connected in the power line 27 for the green signal light. The one-revolution clutch is triggered by a small solenoid 40 activated momentarily as the cam 20 of the synchrolizer passes through "0" after a car has been detected on the side road. The cam 21 of the synchrolizer thereupon activates the ratchet solenoid of the controller only when a blink signal has been theretofore produced. To prevent any possibility of a failure of the equipment in the off-mode causing a disabling of the controller, a shorting switch 41 is connected across the interrupter switch 37 but latched in the open position by a latch 42. If the cam 36 is stopped in position holding the switch 37 open, the latch 42 is released within one-half to three-quarter second by an electromagnet 43 to restore the power line 27 to effective condition.

These and other objects and features of the invention will be apparent from the foregoing description and the appended claim.

I claim:

1. In a traffic control system comprising red, green and yellow signal lights for each direction of traffic at an intersection wherein said lights are controlled to cause only one of said lights to be "on" at any one time in any one direction, and the lights in each direction are shifted at intervals to red and green to indicate changes in the direction of traffic: the combination of a controller with means to provide a short momentary blink of said green and/or red signal lights at a predetermined interval before each change in direction of traffic at said intersection with continuation of the light in a steady condition after the blink; and a marker on a roadway to said intersection placed at a distance from the intersection equal approximately to the normal distance of travel on the roadway within the timing of said blink signal whereby to enable the motorist to interpret said blink signal solely by his location relative to the marker when the blink signal occurs to achieve greater safety and to save gasoline.

2. The traffic control system set forth in claim 1 wherein the controller is of the semi-actuated type having a synchrolizer providing a background cycle of a prescribed timing and wherein the controller is operative normally to maintain the green signal on the main road, a detector on the side road to the intersection, circuit means including said detector and a switch of said synchrolizer for actuating said blink signal upon said switch being operated after detection of a car on the side road, said synchrolizer including a second switch timed to operate at a preset interval after the operation of said first switch, and further circuit means including said second switch and conditioned by operation of said first switch for shifting said controller to change the direction of traffic at said intersection at a present interval after the occurrence of said blink signal.

3. The claim set forth in claim 2 wherein said conditioning means includes a relay operated by the operation of said first switch while said detector stands operated, said relay having a holding circuit and a pair of holding contacts in said holding circuit, and having a pair of normally open contacts in said circuit shifting means closed in conjunction with the operation of said blink signal whereby operation of said shifting means is not enabled without a prior operation of said blink signal, and circuit means connecting the holding circuit for said relay to the green signal light to drop the relay when the green signal lights is cut off by said controller.

4. In a traffic control system comprising red, green and yellow signal lights for each direction of traffic at an intersection wherein said lights are controlled to cause only one of said lights to be "on" at any one time in any one direction and the red and green lights are shifted at intervals to indicate changes in the direction of traffic, and wherein said system includes means to provide a short momentary blink of said green and/or red signal lights at a predetermined interval before each change in direction of traffic at said intersection with continuation as a steady light after the blink: the combination of means for enabling motorists to interpret said blink signal to save gasoline and to achieve greater safety requiring any estimate or count-down of the timing of said blink signal, comprising a marker on a roadway to said intersection placed at a distance from said intersection approximating the distance of travel of vehicles at the speed limit on the roadway within the timing of the blink signal, whereby to inform motorist to start coasting on seeing a blink of the green signal light when at any distance before reaching said marker, and to inform motorists to start coasting and/or to prepare to stop when seeing a blink of the red signal light after passing the marker.

5. The method of informing motorists of an impending change in direction of traffic at an intersection having red, yellow and green signal lights whereby to enable the motorists to gauge their driving to save gasoline and to achieve greater safety without involving any estimate or countdown in time, which comprises momentarily blinking said red and/or green signal lights at a preset interval before the direction of traffic is changed and continuing said red and/or green signal in a steady condition after the blink until the end of the red and/or green phase, placing a marker along a roadway leading to said intersection, and setting the marker at a distance from the intersection approximating that which vehicles normally travel within the timing of the blink signal whereby motorists on seeing a momentary blink signal of the green light before reaching said marker are to start coasting and on seeing a momentary blink signal of a red light after passing said marker are to start coasting and to prepare to stop.

6. The method set forth in claim 5 wherein said roadway has a designated speed limit, and said marker is set approximately at the distance from said intersection which a vehicle travels within the timing of said blink signal when going at said speed limit.

7. The method set forth in claim 5 wherein said marker is mounted in view along said roadway and is provided with distinctive symbols in the direction facing the motorists approaching said intersection.

* * * * *

UNITED STATES PATENT AND TRADEMARK OFFICE

CERTIFICATE OF CORRECTION

PATENT NO. : 4,590,455

DATED : May 20, 1986

INVENTOR(S) : George H. Fritzinger

It is certified that error appears in the above-identified patent and that said Letters Patent is hereby corrected as shown below:

The term of this patent subsequent to April 20, 2000 has been disclaimed.

Signed and Sealed this

Thirteenth Day of October, 1987

*Attest:*

DONALD J. QUIGG

*Attesting Officer*

*Commissioner of Patents and Trademarks*